US005454203A

United States Patent [19]

Turner

[11] Patent Number: 5,454,203

[45] **Date of Patent: * Oct. 3, 1995**

[54] FRAME BRACE

[75] Inventor: Arthur R. Turner, Terranora, Australia

[73] Assignee: Saf-T-Corp, Pasadena, Calif.

[ * ] Notice: The portion of the term of this patent subsequent to May 31, 2011 has been disclaimed.

[21] Appl. No.: 248,607

[22] Filed: May 25, 1994

Related U.S. Application Data

[63] Continuation of Ser. No. 575,225, Aug. 30, 1990, Pat. No. 5,315,803.

[51] Int. Cl.[6] ..... E04C 3/292

[52] U.S. Cl. ..... 52/720.1; 52/368; 52/657; 52/731.7; 52/737.6

[58] Field of Search ..... 52/720, 368, 373, 52/657, 731.7

[56] References Cited

U.S. PATENT DOCUMENTS

| | | | |
|---|---|---|---|
| 713,132 | 11/1902 | Moore | 52/657 |
| 2,746,780 | 5/1956 | Comino | 52/657 |
| 2,856,646 | 10/1958 | Latimer et al. | 52/657 |
| 3,102,306 | 9/1963 | Hutchinson | 52/657 |
| 3,591,997 | 7/1971 | Tennison | 52/657 |
| 4,192,113 | 3/1980 | Martin, Jr. | 52/282 |
| 4,339,903 | 7/1982 | Menge | 52/657 |
| 4,345,409 | 8/1982 | Schroeder et al. | 52/693 |
| 4,455,806 | 6/1984 | Rice | 52/732 |
| 4,503,652 | 3/1985 | Turner | 52/657 |
| 4,637,195 | 1/1987 | Davis | 52/693 |

FOREIGN PATENT DOCUMENTS

| | | | |
|---|---|---|---|
| 484192 | 6/1977 | Australia | 52/657 |

*Primary Examiner*—Carl D. Friedman
*Assistant Examiner*—Wynn E. Wood

[57] ABSTRACT

The present invention comprises a metal brace consisting of a strip of sheet metal the side portions of which are doubled over or bent through about 180 degrees, so that the strip, or at least a nailing flange of the strip, is of double thickness sheet metal. In this way the raw edges of the strip are safely displaced from the sides of the brace. Moreover, it has been found that it is much easier to drive a nail through two superimposed thicknesses of sheet metal than to drive it through a single piece of sheet metal of double the thickness. Therefore the bracing strip according to the invention made of light gauge sheet metal may have high strength in compression, but be easier to nail, without preformed nail holes, than a conventional bracing strip. An alternative embodiment may have formed in it a plurality of access locations to use as nail holes. The portion of the strip which is of double thickness and the access locations (if present) are flattened such that they do not have an overall thickness which is substantially equal to twice the thickness of the sheet metal.

15 Claims, 3 Drawing Sheets

FRAME BRACE

This is a continuation of application Ser. No. 07/575,225, filed Aug. 30, 1990.

BACKGROUND OF THE INVENTION

1. Field of the Invention

This Invention relates to bracing strips for timber-framed buildings.

2. Background Art

A variety of steel bracing strips of different cross-sectional configurations are used for bracing timber wall and roof structures of buildings. The braces are, in most cases, required to have good strength in compression as well as in tension and so are commonly angled, saw cuts being made in the timber members crossed to receive closely a flange of an angled member; or where cyclonic conditions preclude the cutting of studs, the strips are curved, or bent along their center-lines through wide angles, the strips being flattened where nailed to a plate, stud or other member of the frame. One such bracing strip is described in U.S. Pat. No. 4,157,002.

These bracing strips have been found generally satisfactory, but there is some danger of accident to workmen from the raw edges of the metal of which the braces are formed. Another difficulty has been found in nailing bracing strips made of metal of such gauge as will afford adequate strength in compression. To overcome this latter disadvantage many such bracing strips are formed with a series of nail holes.

Another disadvantage is that, as the bracing strips are required in a fairly wide range of lengths, the transport and storage of these presents problems.

The present invention has been devised with the general object of minimizing these disadvantages.

SUMMARY OF THE INVENTION

Accordingly, the invention resides broadly in a metal brace consisting of a strip of sheet metal the side portions of which are doubled over or bent through about 180 degrees, forming inwardly directed flanges, so that the strip, or at least a nailing flange of the strip, is of double thickness sheet metal. In this way the raw edges of the strip are safely displaced from the sides of the brace. It has also been found that the flanges reinforce the strip and impart additional compression. Moreover, it has been found that it is much easier to drive a nail through two superimposed thicknesses of sheet metal than to drive it through a single piece of sheet metal of double the thickness. Therefore the bracing strip according to the invention made of light gauge sheet metal may have high strength in compression, but be easier to nail, without preformed nail holes, than a conventional bracing strip. Even if two bracing strips according to the invention should be overlapped, a nail may be driven through the overlapped portion without undue difficulty, and therefore strips according to the invention may be made in fewer standard lengths which may be overlapped as required.

In another aspect, the invention resides broadly in a bracing strip including two parts slidably interfitted for telescopic length adjustment, each part being formed with a series of integral teeth or tongues formed, for example, by V-shaped or U-shaped cuts, and such that a nail may be driven through the strip, or an overlapped part thereof, and into a timber wall member to deform a tooth or tongue, or a pair of registering teeth or tongues of overlapped parts, into the timber member.

Other features of the invention will become apparent from the following description.

BRIEF DESCRIPTION OF THE DRAWINGS

Various embodiments of the invention are shown, by way of illustrative example only, in the accompanying drawings, wherein.

DETAILED DESCRIPTION OF THE PRESENT INVENTION

Figure 1:
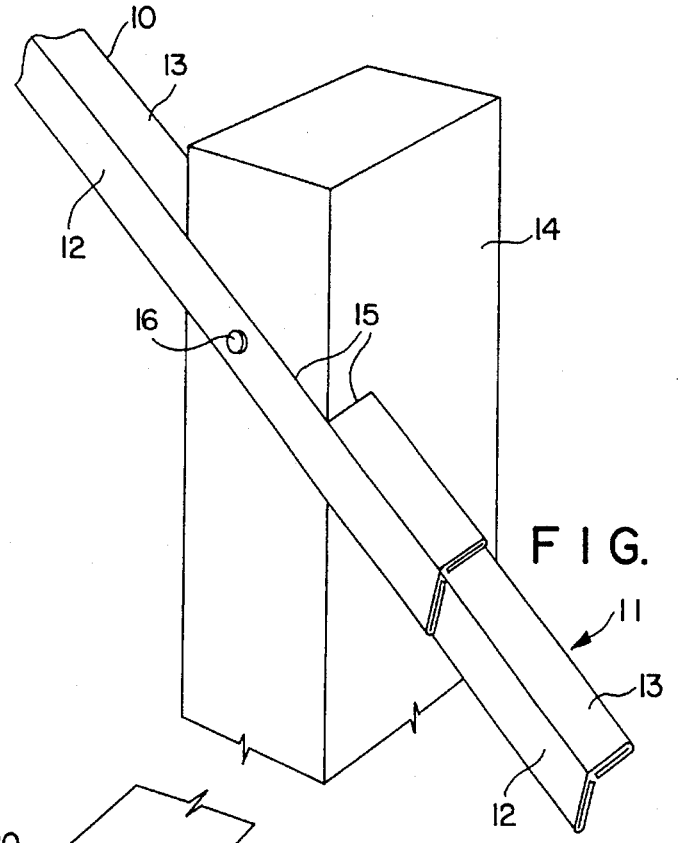
FIG. 1 is a perspective view of part of an angle brace according to the invention, overlapped and fixed to a timber stud.

Referring initially to FIG. 1 of the drawings, the angle brace illustrated consists of two similar sections 10 and 11, each comprising two equal flanges 12 and 13 perpendicular to each other. The brace is formed of a single strip of, for example, galvanized sheet steel of which the two side edge portions are bent over through 180 degrees, these parts being of such width that they almost meet, the whole then being bent through a right angle along its longitudinal center-line. Each of the flanges 12 and 13, then, is of double thickness. The gauge of the sheet metal is lighter than that used for a normal angle brace, but the combined thickness of the two layers of each flange is equal to or somewhat greater than that of a conventional angle brace, and at all events is such that the strength in compression of the improved brace is at least equal to that of a conventional brace.

Figure 11:
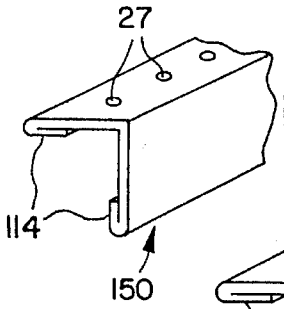
FIG. 11 is a perspective view of part of an angle brace having dimples thereon.
Figure 12:
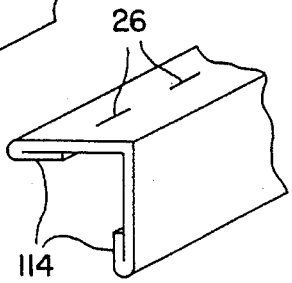
FIG. 12 is a perspective view of part of an angle brace having roller scored slits thereon.

In use, the brace is first fixed, at its ends, to two members of a timber wall or roof structure, normally, in a wall, to top and bottom plates, the brace being oblique to cross one or more studs 14. At each place where the brace is fixed, a saw cut as indicated at 15 is made to accommodate closely one flange 13 of the brace. The brace having been fixed to the top and bottom plates, the frame can be racked to bring it square, whereupon the brace is fixed to the central stud by one or more nails 16. In the example illustrated, the sections 10 and 11 of the brace are overlapped at the stud 14 so that each nail 16 will be driven through four thicknesses of the sheet metal. This, however, will normally be done without any undue difficulty. If the gauge of the sheet metal is required to be such that difficulty will be experienced in driving the nails, holes may be formed through one thickness of flange 12; or both thicknesses if preferred. The nail holes may be round or slotted, or if preferred there may be formed in the flange a series of tongues defined by V-shaped (e.g. cuts 134 of FIG. 8) or U-shaped cuts (e.g. cuts 28 of FIG. 4) in one or both thicknesses of the flange, the tongues extending laterally or longitudinally with respect to the strip and being displaced by nails driven through the brace. Alternatively, roller scoring (see scoring marks 26 of FIGS. 3 and 12) of the brace along its longitudinal axis may be utilized in place of the formation of holes. The scoring does not extend completely through the brace, but the reduced thickness at the score mark allows easy penetration of nails. Further, a plurality of dimples 27 may be formed in a brace such as in angle brace 150 shown in FIG. 11. As with the scoring, the dimples do not extend completely through the brace but only partially. The dimples 27 also provide a reduced thickness to provide easy insertion of a nail.

Figure 2:
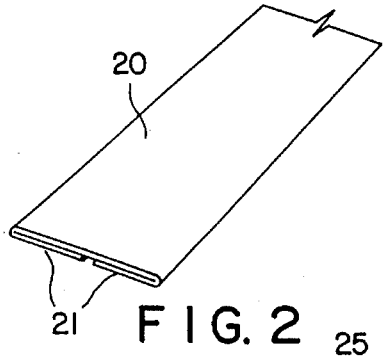
FIG. 2 is a perspective view of part of a flat bracing strip according to the invention.

In the embodiment of FIG. 2, a flat strap brace 20 is provided, its side portions 21 being bent in opposite directions through angles of 180 degrees so that the edges of these portions meet or are close. If desired, a groove (viewed from above) may be formed along the longitudinal center line of the metal strip, the edges of the inturned side portions 21 being brought up to the consequent bead along the bottom of the strip. The groove will serve as a guide for the nails to be driven through the strip which, being of single thickness along this groove, will be easily nailed.

Figure 3:
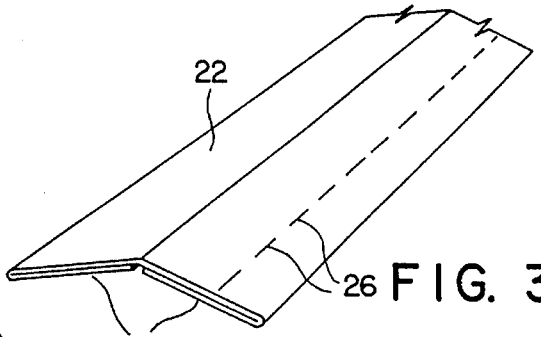
FIG. 3 is a perspective view of part of an obtusely angled bracing strip according to the invention.

The embodiment of FIG. 3 is a fairly wide strip 22 bent to a wide angle along its longitudinal center line, its side portions 23 being bent inwardly to meet, or nearly meet, below the central bend of the strip, such a brace being secured by nails through its doubled-over side portions and consequently flattened where it crosses a timber member.

Figure 4:
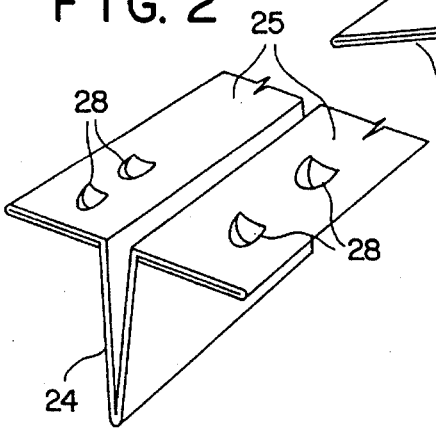
FIG. 4 is a perspective view of part of a T-section brace according to the invention.

In the T-brace shown in FIG. 4 a strip of sheet metal is shaped to form a central deep and narrow V-shaped section 24 flanked by a pair of co-planar nailing flanges 25 each of which has its side portions bent inwardly so that the flanges are of double thickness steel metal as, of course, is the central V-section. The central V-section is driven into a saw cut in any member of the frame crossed by the brace, the flanges 25 being nailed to the member.

It will be seen that all of the side edges of the braces described are of doubled-over sheet metal rather than a raw edge, and so accidental cuts to workmen from sharp edges should be obviated. At the same time the braces may be made of relatively light gauge sheet metal, and may be easily nailed, even when overlapped. Therefore the braces may be provided in fewer lengths than have previously been required to satisfy all building requirements.

Although the flange portions of the braces of FIGS. 1– 4 are shown as folded completely under the brace so that the edges adjoin, any amount of fold providing at least a portion of brace having double thickness may be employed. For example, in FIGS. 5–10 embodiments of the present invention are illustrated in which the edges are only turned under sufficiently to form an edge bead the length of the brace.

Regardless of the length of the flange formed by folding an edge through 180 degrees, improved strength and compression of a frame brace is the result. Under a compressive load, a prior art frame brace having no edge beads or fold under, will tend to buckle with the edges at the failure point moving away from each other. With an edge bead or fold under introduced into the frame, improved compressive strength and rigidity is the result. Under a compressed load, a compressive force acting at the edge beads tend to force the edge inward, counteracting the force acting on the entire brace tending to force the edge outward.

Figure 5:
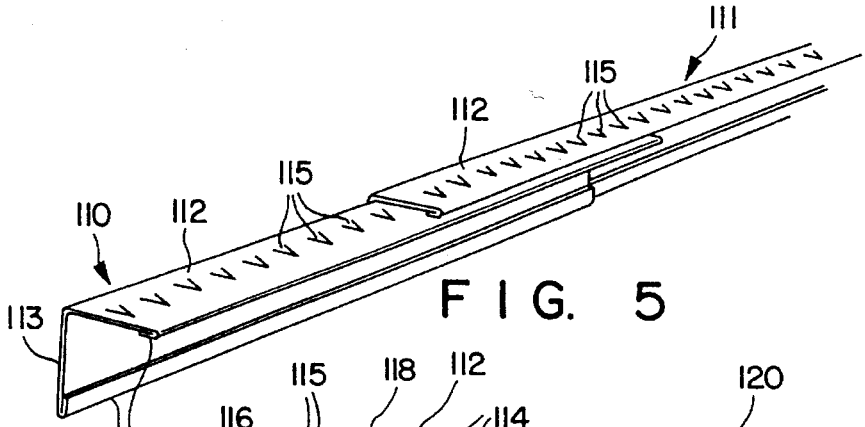
FIG. 5 is a perspective view of a telescoping angle bracing strip according to the invention.

The angle brace shown in FIG. 5 consists of two similar and slidably interfitted angle brace sections 110 and 111, each comprising a strip of galvanized sheet steel or other suitable material bent through a right angle along a central longitudinal line to form two perpendicular flanges 112 and 113. The edge portion of each of these flanges is bent over through about 180 degrees to form an edge bead 114. See also the angle braces of FIGS. 11 and 12. The provision of these beads 114 considerably increases the strength of the bracing strip in compression, so that a rather lighter gauge of sheet metal than usual may be used without sacrifice of the brace's characteristics. Furthermore, the beads give rounded, rather than dangerous raw sheet metal edges, to the bracing strip, so that accidental cuts from the article will be eliminated.

One flange 112 of each of the sections is formed with a series of equally spaced and laterally extending teeth or tongues 115, each defined by a V-shaped cut in the sheet metal, and being down-pressed a short distance so that its point extends slightly into the angle of the brace.

Figure 6:
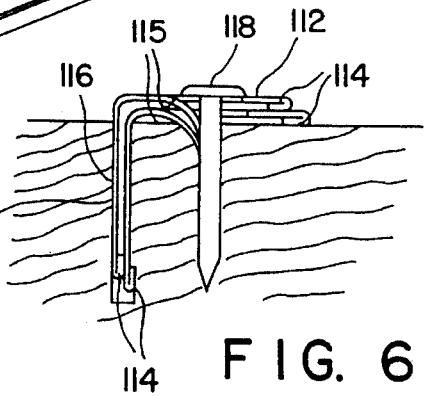
FIG. 6 is a cross-sectional view of the bracing strip shown in FIG. 5, fixed by a nail to a timber member.

The two angle brace sections 110 and 111 may be used to make up a complete brace, the ends of which are nailed to the top and bottom plates for example of a timber wall frame which is racked to make it square before fixing the brace, where the two brace sections overlap, to the center stud of the wall frame. At each position where the brace is nailed to the frame, at the plates and to intermediate studs, a saw cut as indicated at 116 in FIG. 6, is made in the timber member 117 to receive closely the flange 113, or overlapped flanges 113. At each such position, a nail 118 is driven through the angle brace 110 and into the timber member 117 to displace a tooth 115 or registering teeth 115, forcing them some way into the timber member and giving the brace additional shear value at this position. Where the brace sections 110 and 111 overlap, the teeth 115 of the two sections tend to interlock. Where the bracing strip is exposed, between studs and other members of the timber frame, its edges present no dangerously sharp edges to cause accidents to workmen.

In each of the embodiments of the invention shown in FIGS. 7, 8, 9 and 10, the braces of different types are made in two or more sections which are slidably interfitted for telescopic adjustment.

Figure 7:
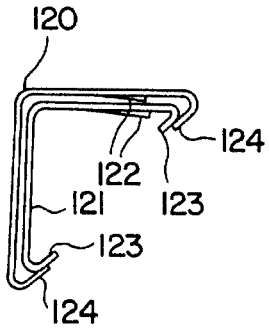
FIG. 7 is a cross-sectional view of a modified form of a telescoping angle brace according to the invention.

FIG. 7 shows in section an angle brace consisting of two telescopically interfitted sections 120 and 121, each with two perpendicular flanges, corresponding flanges of the two being formed with series of teeth 122 as before described. In this embodiment, however, the flanges of the outer section 120 are somewhat wider than those of the inner section 121. The edge portions of the flanges of the inner section 121 are bent over into the angle of the section to form edge beads 123, and the edge portions of the flanges of the outer section 120 are bent over to form edge beads 124 which engage the inner section edge beads 123. There is sufficient clearance between the outer and inner sections to allow the inner section 121 to be adjusted telescopically relative to the outer flange despite the teeth 122; but if preferred the teeth, instead of being pressed a short distance inwardly may remain flush with their flanges; or those of the outer section may be flush, those of the inner section being pressed inwardly. Alternatively, the teeth may be formed in a flange of the inner section only, the corresponding flange of the outer section being formed instead with registering holes.

Figure 8:
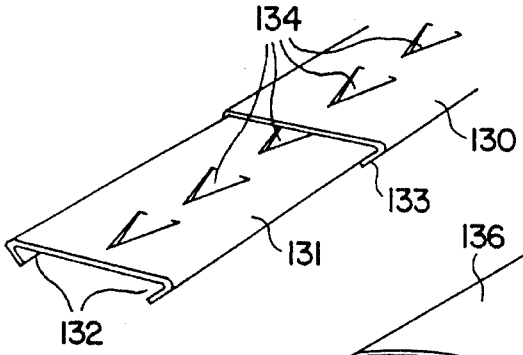
FIG. 8 is a perspective view of a telescoping strap brace according the invention.

FIG. 8 shows part of a strap brace comprising telescopically or slidably interfitted sections 130 and 131. Each of the sections is an elongated sheet metal strip, the edge portions of the inner strip 131 being in-folded to form edge beads 132, the edge portions of the wider outer strip 130 being similarly infolded to form edge beads 133 which slidably engage the inner strip edge beads 132. Each of the sections 130 and 131 is formed with a series of teeth 134 generally similar to those before described except that they are directed longitudinally with respect to the brace instead of laterally.

If the two sections 130 and 131 of the brace are of equal length, the brace can be extended telescopically to almost double that length, an overlap of about six inches being generally desirable in the extended brace. The brace may be fixed at the ends to top and bottom plates and at its overlapped middle part to a central stud. This type of brace is used without any saw-cuts being made in the members to which it is nailed and so may be preferred in cyclonic areas. At the same time, the inturned edge beads 132 and 133, in addition to their safety feature, add considerable strength in compression to the brace. Where the brace is nailed, the safety beads are of course flattened by the hammer blows.

Figure 9:
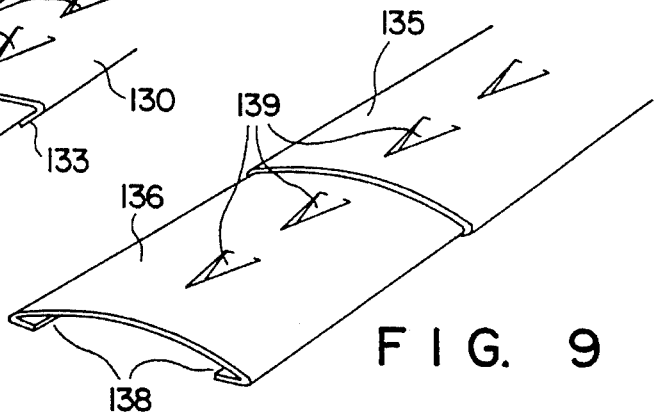
FIG. 9 shows in perspective a transversely curved telescoping brace according to the invention.
Figure 10:
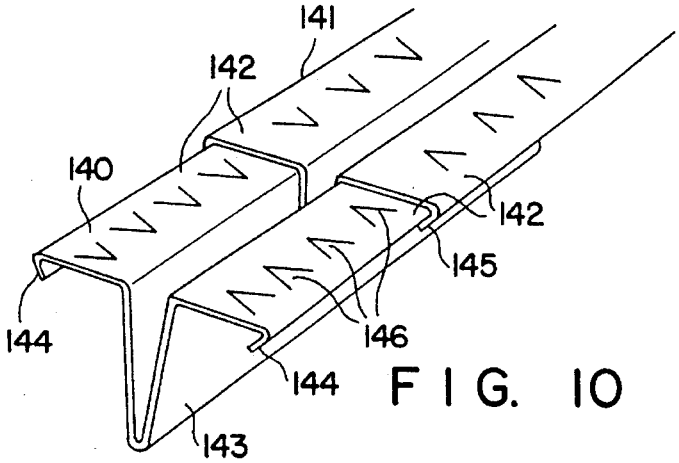
FIG. 10 is a perspective view of a telescoping T-brace according to the invention.

The brace shown in FIG. 9 is generally similar to that of FIG. 8 except that the two interfitted sections 135 and 136 are transversely curved rather than flat, their side edge portions being inturned to form slidably engaged edge beads 137 and 138, both strips being formed with longitudinally arranged teeth 139. If preferred the strips may be bent at their longitudinal center-lines at corresponding obtuse angles instead of being curved laterally. The teeth, in this case, may be to one side of the bend line. The embodiment of the invention shown in FIG. 10 is a T-brace, composed of first section 140 and a second section 141, each roll-formed or otherwise shaped to more or less T-shaped cross-section with two co-planar flanges 142 joined by a fairly deep and narrow V-shaped middle part 143. The side edge portions of the first section 140 are inturned to form edge beads 144. The V-shaped central part 143 of the second section 141 is fitted closely in the central part of the first section 140. The side edge portions of the flanges 142 of the section 141, which are somewhat wider than those of the first section 140, are inturned to form edge beads 145 slidably engaging the edge beads 144 of the first section 140.

In both flanges of each section laterally extending teeth 146 are defined by V-shaped cuts. This form of brace is installed by making saw-cuts in the timber member of the wall frame to accept the narrow middle parts 143 of the brace.

In a modification of this embodiment the two sections of the brace are interfitted but not telescopically engaged, both sections being of similar cross-sectional configuration and both with their edge beads bent in close to their side flanges.

From the drawings it will be appreciated that the side beads of the braces may be inturned at any of a range of angles. The additional rigidity imparted by these edge beads will permit the braces to be made of lighter gage sheet metal than is normally the case, without loss of effectiveness.

Although in the embodiment of the present invention of FIGS. 5–10, V-shaped or U-shaped tongues are used to provide openings through which nails may be driven, other means for providing nail locations may be utilized as well. For example, roller scoring (see FIG. 3) of the brace longitudinally may be employed in lieu of the openings. The scoring does not extend through the brace but rather provides a point of reduced thickness through which a nail may be easily driven. Similarly, a series of dimples (see FIG. 4), or indentations, may be formed in the surface of the brace without extending through the brace. As with the roller scoring, these dimples provide a reduced thickness of brace through which a nail must be driven.

As previously described, the edge beads of the present invention provide additional rigidity to the braces, allowing them to be made of lighter gage sheet metal without loss of effectiveness. The light gauge metal also obviates the necessity of having the nail holes (tongues, scoring, dimples, etc.) in alignment in separate telescoping sections of the brace. In other words, there is no requirement that the openings of one section align with the openings of an overlapping telescoping section.

Although the embodiments of FIGS. 1–4 have been described in terms of a complete doubling over of the brace material, the configurations of FIGS. 1–4 may also be utilized employing only the edge beads of FIGS. 5–10. In addition, the embodiments of FIGS. 1–4 may be utilized in telescoping fashion and overlapping fashion as well.

Even with all of the advantages of the foregoing embodiments, it has been found desirable to make the frame brace as thin as possible. In particular, when the frame brace as described above is used in construction, a portion of the flange is left exposed on the outer surface of the studs to which it is attached. Then, when the studs are covered over with dry-wall, the frame brace may cause a slight "bulge" or waviness to be formed in the covering material. The size of the bulge in the covering material is, of course, directly related to the thickness of the frame brace. It has therefore been found that the foregoing problem can be obviated by reducing the thickness of the frame brace as much as possible.

The thickest portion of the frame brace may occur where the edges of the sheet metal are folded back onto themselves, thereby forming a double layer of material. While sheet metal is normally thin, this double thickness can at times be unacceptable if accompanied by any significant radius in the the bond. Also, when the nail access locations are formed into the frame brace, they create inwardly raised portions which increase the thickness of frame brace in that region. While nailing through such a nailing region flattens the material in that region, not all such regions or studs are used for nailing. This effect can even exceed the thickness of the double thickness portion. An improvement in the embodiments described above can be made by flattening the fold of the double portion and flattening the access depressions accordingly so as to minimize the profile of the frame brace.

Figure 15:
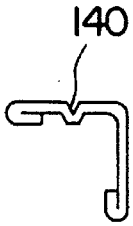
FIG. 15 is a cross section of an angle brace taken through the nailing dimples illustrating the same after rolling.

The flattening of the double layer of material and the access locations can be easily accomplished during manufacture. For example, the frame brace can be passed between rollers (not shown) after the flanges are folded and the nail depressions have been formed. By moving the double layer of material through rollers of either a fixed spacing or of a relatively high spring preload, the double layer of the material and the access locations are flattened such that the overall thickness of the frame brace is substantially equal to a double thickness of the sheet metal. In practice, the nail depressions tend to be flattened slightly more, so that the effective thickness in the region of the nail depressions is slightly less than two material thicknesses. (See FIGS. 13 and 15 for cross sections through a T-brace and an angle brace respectively, the cross sections being taken through the nail depressions.) In this manner, the frame brace retains all of the advantages as described above and overcomes the problems of creating bulges in the wall material used to cover the framing material. It will be apparent to those skilled in the art that various other means of compressing the double layer of material can be used to achieve the results described above.

Figure 13:
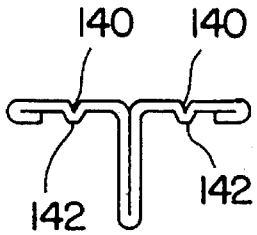
FIG. 13 is a cross section of a T-brace taken through the nailing dimples illustrating the same after rolling.
Figure 14:
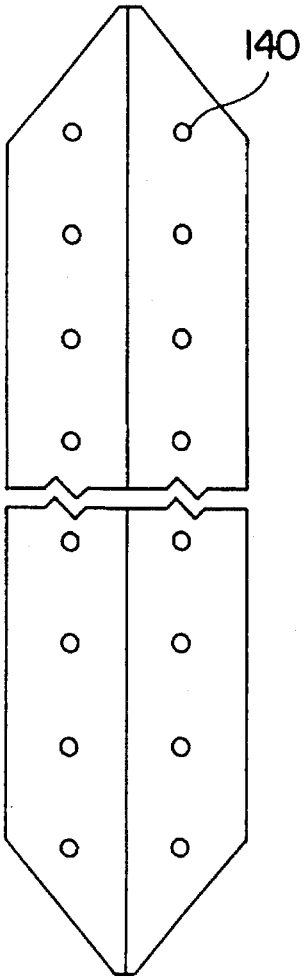
FIG. 14 is a plan view of the T-brace of FIG. 13 showing the angled or tapered ends thereof.
Figure 16:
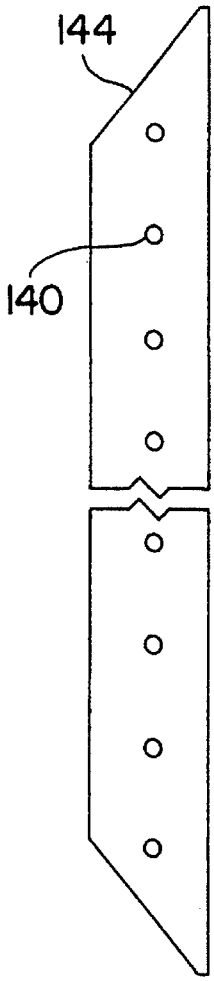
FIG. 16 is a plan view of the angle brace of FIG. 15 showing the angled or tapered ends thereof.

FIGS. 14 and 16 illustrate another aspect of the present invention for a T-brace and angle brace, respectively. These figures are planform drawings of the T-brace and angle brace, respectively, shown in the cross sections of FIGS. 13 and 15. In that regard, FIG. 13 illustrates the nailing depressions or dimples of the T-brace. The bottom surface 142 thereof, to the extent that it may have been initially formed to extend below the double thickness dimension of the sheet material, is flattened and/or forced upward when the flanges of the formed T-brace are rolled to assure that no part of the flanges is any thickness significantly greater than the two thicknesses of the material at the rolled edges thereof. FIG. 14, on the other hand, illustrates the preferred angling or tapering of the ends of the T-brace. Such angling is desired as it allows an installer to nail the end of the T-brace to the top plate or bottom plate without difficulty and without the installer having to cut off or bend over any excess material. Similarly, in FIG. 16 an angle brace is illustrated, the brace also having the ends 144 angled for the same purpose. Such angling is easily accomplished during manufacturing and provides a substantial convenience to the installers at the time of installation.

The invention, although of simple character, will be found to be very effective in achieving the objects for which it has been devised. It will, of course, be understood that the particular embodiments herein described and illustrated by way of example only may be subject to many modifications of detail and design without departing from the ambit of the invention.

I claim:

1. A wood frame construction brace comprising:

an elongated rigid strip having first and second sections disposed about a longitudinal axis of said strip, each section terminating in a folded portion which is folded through an angle of approximately 180 degrees so as to be adjacent an adjacent unfolded portion of said strip, said elongated rigid strip having a nail access feature that facilitates the passage of a nail through said rigid strip and which is located in both said folded portion and said unfolded portion of said rigid strip.

2. The frame brace of claim 1 wherein said strip is bent along said longitudinal centerline of said strip such that said first and second sections are at an angle to each other.

3. The brace of claim 2 wherein said angle is approximately 90 degrees.

4. The brace of claim 1 wherein said brace is comprised of sheet metal.

5. The brace of claim 1 wherein said nail access feature is disposed colinearly and longitudinally in said brace.

6. The brace of claim 5 wherein said nail access feature comprise a plurality of dimples extending partially through said brace.

7. The brace of claim 6 wherein each folded portion lies flat against the adjacent unfolded portion and said dimples are limited in extent so that the thickness of the brace over the folded and adjacent unfolded portions and over said dimples is no more than substantially equal to twice the thickness of the strip of material.

8. The brace of claim 1 wherein each folded portion lies flat against the adjacent unfolded portion so that the thickness of the brace over the folded and adjacent unfolded portions is essentially equal to twice the thickness of the of the strip of material.

9. A wood frame construction brace comprising:

an elongated rigid strip having first and second sections disposed at approximately 90 degrees relative to each other about a longitudinal axis of said strip, each section terminating in a folded portion which is folded through an angle of approximately 180 degrees so as to be adjacent an adjacent unfolded portion of said strip; and, nail access means for facilitating the passage of a nail through said rigid trip, said nail access means being located in both said folded portion and said unfolded portion of said rigid strip.

10. The frame brace of claim 9 wherein each folded portion lies flat against the adjacent unfolded portion and said means for facilitating the passage of a nail are limited in extent so that the thickness of the brace over the folded and adjacent unfolded portions and over the means for facilitating the passage of a nail is no more than twice the thickness of the strip of material.

11. The frame brace of claim 9 wherein the ends of at least one of said sections are tapered.

12. A method of forming a frame brace; comprising the steps of:

providing an elongated rigid strip having first and second sections disposed about a longitudinal centerline of said strip; and, folding a terminal portion of each of said first and second sections through an angle of approximately 180 degrees so that said folded terminal portion is adjacent to an adjacent unfolded portion of said strip, said elongated rigid strip having a nail access feature that facilitates the passage of a nail through said rigid strip and which is located in both said folded portion and said unfolded portion of said rigid strip.

13. The method of claim 12 further including the step of bending said elongated rigid strip along said longitudinal centerline so that said first and second sections are disposed at a relative angle of approximately 90 degrees.

14. The method of claim 13 wherein said step of forming a plurality of access locations includes forming said access locations equidistantly from said longitudinal centerline.

15. The method of claim 13 further comprising the step of tapering the ends of at least one of said sections.

* * * * *